US006546680B1

(12) United States Patent
Watts

(10) Patent No.: US 6,546,680 B1
(45) Date of Patent: Apr. 15, 2003

(54) LEVEL TRANSITION DEVICE FOR PORTABLE BUILDINGS

(75) Inventor: Bruce D. Watts, Greens Fork, IN (US)

(73) Assignee: Connie Watts, Greens Fork, IN (US)

( * ) Notice: Subject to any disclaimer, the term of this patent is extended or adjusted under 35 U.S.C. 154(b) by 0 days.

(21) Appl. No.: 09/840,615

(22) Filed: Apr. 23, 2001

(51) Int. Cl.[7] ..... E04F 11/00

(52) U.S. Cl. ..... 52/182; 52/126.1; 52/182; 52/79.1; 52/731.1; 52/183; 52/363

(58) Field of Search ..... 52/126.1, 79.6, 52/182, 79.1, 731.1, 183, 363, 730.7; 248/346.01, 346.02, 188.2; 144/345, 355; 482/83; 353/120; 254/104; 446/85, 86, 117, 124, 125

(56) References Cited

U.S. PATENT DOCUMENTS 4,083,557 A * 4/1978 Friedenthal ..... 272/76
5,209,458 A * 5/1993 Eubank et al. ..... 254/88
5,357,876 A * 10/1994 Kniefell et al. ..... 108/92
5,815,992 A * 10/1998 Wells et al. ..... 52/126.1
5,870,876 A * 2/1999 Deiter ..... 52/731.1
6,318,033 B1 * 11/2001 Birch et al. ..... 52/182

OTHER PUBLICATIONS

Http://www.mustangworld.com/ourpics/webmas/ramps.htm Nov. 20, 2000.*
US Publication Mustangworld Ramps by Glenn Moller @ http://www.mustangworld.com/ourpics/News/mwramps/.*

* cited by examiner

*Primary Examiner*—Carl D. Friedman
*Assistant Examiner*—Nahid Amiri
(74) *Attorney, Agent, or Firm*—Woodard, Emhardt, Naughton, Moriarty & McNett LLP

(57) ABSTRACT

The present invention comprises various combinations of 2"×4", 2"×6", 2"×8", 2"×10" and 2"×12" members stacked on top of one another with one longitudinal edge of each member co-aligned. In this configuration, the non-aligned longitudinal edges form shallow steps which act as a ramp, allowing wheeled implements to easily transition form ground level to the floor level of the portable building.

6 Claims, 2 Drawing Sheets

LEVEL TRANSITION DEVICE FOR PORTABLE BUILDINGS

TECHNICAL FIELD OF THE INVENTION

The present invention generally relates to portable buildings and, more particularly, to a level transition device for portable buildings.

BACKGROUND OF THE INVENTION

Portable buildings, such as small garden sheds or yard barns, are popular means for providing an enclosed storage area or workspace near one's home. Typically, the portable building is either constructed on-site or constructed off-site and transported to the site where the building is to be used. In either case, the building is typically constructed so that it simply rests upon a relatively flat piece of ground, with no masonry foundation. Not only does this reduce cost, but it allows for easy movement of the building to another location in the future.

One drawback of the lack of a finished foundation is that the floor threshold at the entrance to the portable building is raised significantly above the level of the surrounding ground, typically about eight (8) inches. While this height differential is not significant for persons walking into and out of the portable building, it does represent a significant obstacle to rolling implements, such as lawn mowers, wheelbarrows and hand trucks.

There is therefore a need to a device that will allow for rolling implements to easily ingress and egress to and from a portable building. The present invention is directed toward meeting this need.

SUMMARY OF THE INVENTION

The present invention comprises various combinations of 2"×4", 2"×6", 2"×8", 2"×10" and 2"×12" members stacked on top of one another with one longitudinal edge of each member co-aligned. In this configuration, the non-aligned longitudinal edges form shallow steps which act as a ramp, allowing wheeled implements to easily transition from ground level to the floor level of the portable building.

In one form of the invention a level transition device for a portable building is disclosed, the level transition device comprising a first board having cross-section dimensions of approximately 2"×4" and cut to a predetermined length; a second board having cross-sectional dimensions of approximately 2"×6" and cut to the predetermined length; a third board having cross-sectional dimensions of approximately 2"×10" and cut to the predetermined length; a fourth board having cross-sectional dimensions of approximately 2"×12" and cut to the predetermined length wherein the first, second, third and fourth boards are stacked such that a longitudinal edge of each of said boards are substantially co-aligned; a first hole drilled through the first, second, third and fourth boards; a second hole drilled through the first, second, third and fourth boards; a first bolt disposed through the first hole; a first nut secured to the first bolt; a second bolt disposed through the second hole; and a second nut secured to the second bolt whereby the first, second, third and fourth boards are held securely together.

In another form of the invention, a portable building is disclosed comprising an enclosure; an opening in the enclosure; a sill disposed in the opening; a level transition device coupled to the sill, the level transition device comprising a first board having cross-section dimensions of approximately 2"×4" and cut to a predetermined length; a second board having cross-sectional dimensions of approximately 2"×6" and cut to the predetermined length; a third board having cross-sectional dimensions of approximately 2"×10" and cut to the predetermined length; a fourth board having cross-sectional dimensions of approximately 2"×12" and cut to the predetermined length wherein the first, second, third and fourth boards are stacked such that a longitudinal edge of each of said boards are substantially co-aligned; a first hole drilled through the first, second, third and fourth boards; a second hole drilled through the first, second, third and fourth boards; a first bolt disposed through the first hole; a first nut secured to the first bolt; a second bolt disposed through the second hole; and a second nut secured to the second bolt whereby the first, second, third and fourth boards are held securely together.

In yet another form of the invention, a level transition device for a portable building is disclosed, the level transition device comprising a first board having cross-section dimensions of approximately 2"×4" and cut to a predetermined length; a second board having cross-sectional dimensions of approximately 2"×8" and cut to the predetermined length; a third board having cross-sectional dimensions of approximately 2"×12" and cut to the predetermined length; wherein the first, second, and third boards are stacked such that a longitudinal edge of each of said boards are substantially co-aligned; a first hole drilled through the first, second, and third boards; a second hole drilled through the first, second, and third boards; a first bolt disposed through the first hole; a first nut secured to the first bolt; a second bolt disposed through the second hole; and a second nut secured to the second bolt; whereby the first, second, and third boards are held securely together.

In another form of the invention, a portable building is disclosed comprising an enclosure; an opening in the enclosure; a sill disposed in the opening; a level transition device coupled to the sill, the level transition device comprising a first board having cross-section dimensions of approximately 2"×4" and cut to a predetermined length; a second board having cross-sectional dimensions of approximately 2"×8" and cut to the predetermined length; a third board having cross-sectional dimensions of approximately 2"×12" and cut to the predetermined length; wherein the first, second, and third boards are stacked such that a longitudinal edge of each of said boards are substantially co-aligned; a first hole drilled through the first, second, and third boards; a second hole drilled through the first, second, and third boards; a first bolt disposed through the first hole; a first nut secured to the first bolt; a second bolt disposed through the second hole; and a second nut secured to the second bolt; whereby the first, second, and third boards are held securely together.

In another form of the invention, a level transition device for a portable building, the level transition device comprising a first board having cross-section dimensions of approximately 2"×4" and cut to a predetermined length; a second board having cross-sectional dimensions of approximately 2"×6" and cut to the predetermined length; a third board having cross-sectional dimensions of approximately 2"×8" and cut to the predetermined length; a fourth board having cross-sectional dimensions of approximately 2"×10" and cut to the predetermined length; a fifth board having cross-section dimensions of approximately 2"×12" and cut to the predetermined length; wherein the first, second, third, fourth and fifth boards are stacked such that a longitudinal edge of each of said boards are substantially co-aligned; a first hole drilled through the first, second, third, fourth and fifth boards; a second hole drilled through the first, second, third, fourth and fifth boards; a first bolt disposed through the first hole; a first nut secured to the first bolt; a second bolt disposed through the second hole; and a second nut secured to the second bolt; whereby the first, second, third, fourth, and fifth boards are held securely together.

In yet another form of the invention, a portable building is disclosed comprising an enclosure; an opening in the enclosure; a sill disposed in the opening; a level transition device coupled to the sill, the level transition device comprising a first board having cross-section dimensions of approximately 2"×4" and cut to a predetermined length; a second board having cross-sectional dimensions of approximately 2"×6" and cut to the predetermined length; a third board having cross-sectional dimensions of approximately 2"×8" and cut to the predetermined length; a fourth board having cross-sectional dimensions of approximately 2"×10" and cut to the predetermined length; a fifth board having cross-sectional dimensions of approximately 2"×12" and cut to the predetermined length; wherein the first, second, third, fourth and fifth boards are stacked such that a longitudinal edge of each of said boards are substantially co-aligned; a first hole drilled through the first, second, third, fourth and fifth boards; a second hole drilled through the first, second, third, fourth and fifth boards; a first bolt disposed through the first hole; a first nut secured to the first bolt; a second bolt disposed through the second hole; and a second nut secured to the second bolt; whereby the first, second, third, fourth and fifth boards are held securely together.

DETAILED DESCRIPTION OF THE PREFERRED EMBODIMENTS

Figure 1:
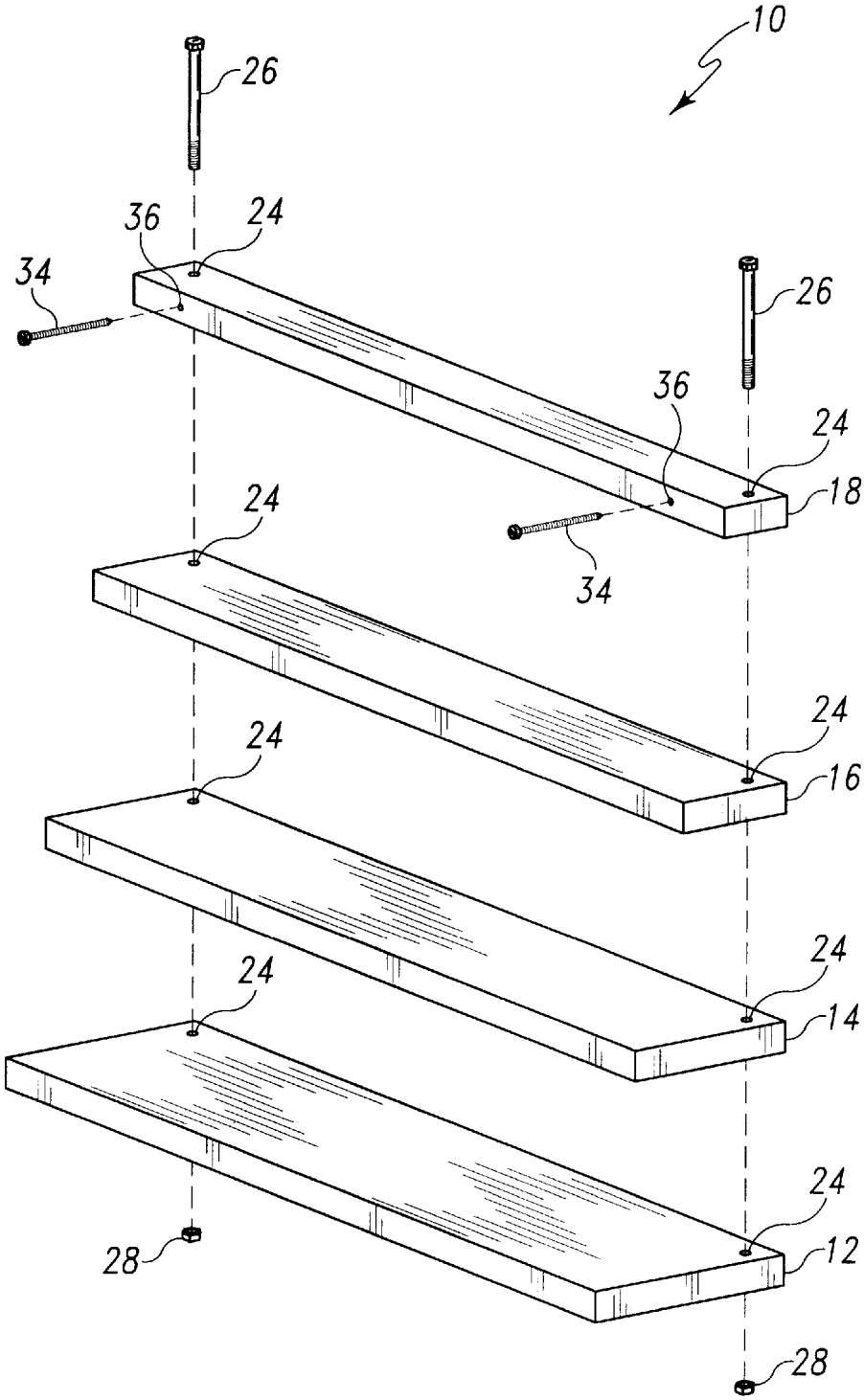
FIG. 1 is an exploded perspective view of a preferred embodiment level transition device of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

With reference to FIG. 1, a preferred embodiment level transition device of the present invention is illustrated and indicated generally at 10. The level transition device 10 is comprised of four lengths of board stock (preferably treated wood) cut to a length substantially equal to the width of the door opening of the portable building to which it will be attached (typically four (4) feet).

A first board 12 is preferably formed from 2"×12" board stock. A board 14 rests upon board 12 and is preferably cut from 2"×10" board stock. A board 16 rests upon the board 14 and is preferably cut from 2"×6" board stock. Finally, a board 18 rests upon the board 16 and is preferably cut from 2"×4" board stock. All of the boards 12–18 are preferably cut to the same width (substantially corresponding to the width of the door opening). It will be appreciated by those having ordinary skill in the art that the dimensions given above are approximate and refer to standard dimensional labels given to the board stock, even though the finished dimensions of the board stock are typically slightly less than the quoted dimensions.

Figure 2:
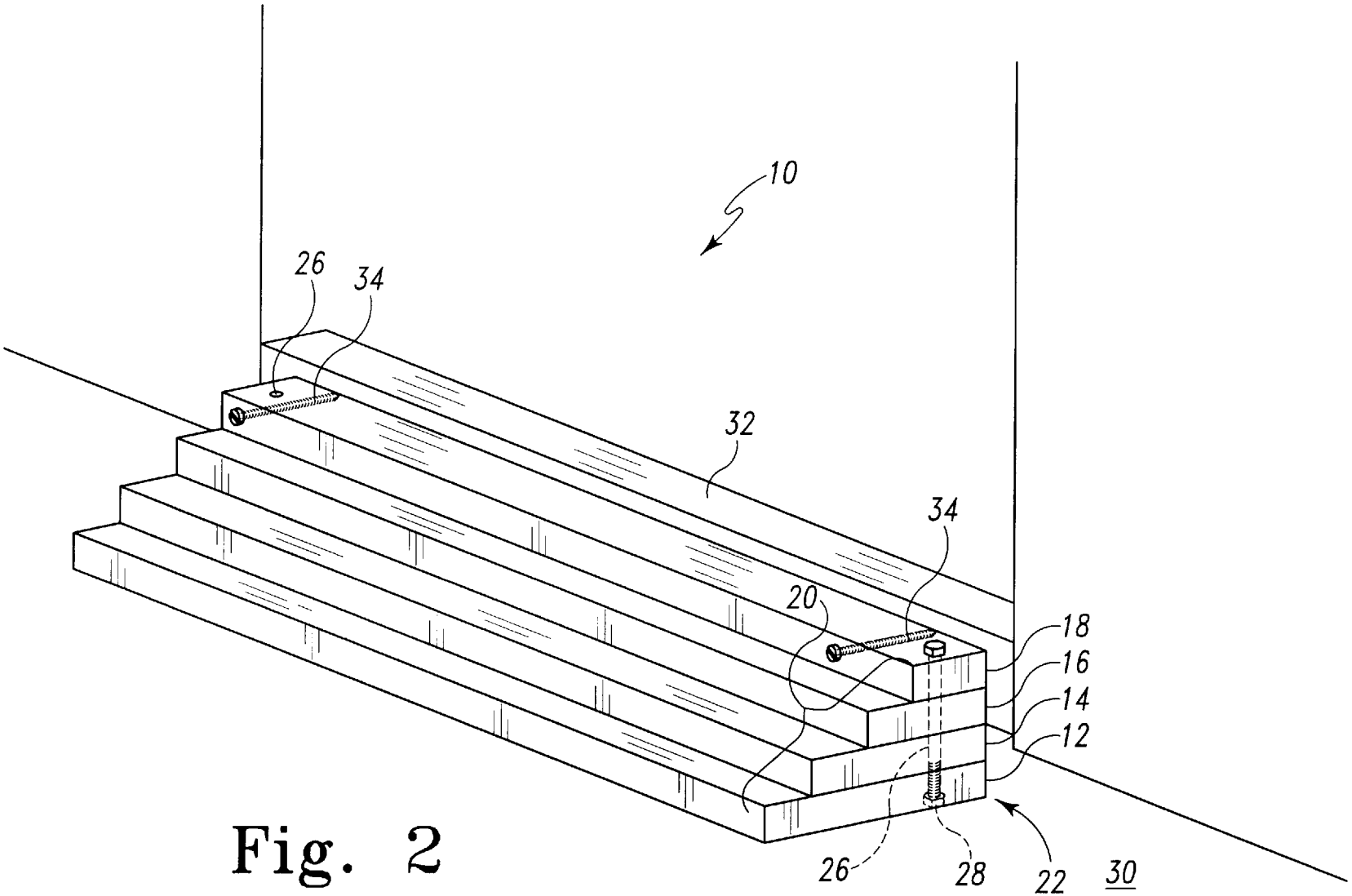
FIG. 2 is a perspective view of the preferred embodiment level transition device of FIG. 1, installed on a portable building.

As can be seen from reference to FIG. 2, stacking the boards 12–18 results in a series of small steps 20, which will behave as a discontinuous ramp when a wheel having a diameter of approximately four inches or greater is rolled up or down the steps 20. This is because the two-inch rise of each step within the steps 20 is not a significant rise when compared to the diameter of the wheel.

As can also be seen from FIG. 2, the boards 12–18 are aligned with one another along one longitudinal edge 22 thereof. A hole 24 is then drilled through all of the boards 12–18 and a carriage bolt 26 is passed therethrough and secured with a nut 28. In a preferred embodiment, the hole 24 is countersunk on both ends such that the head of the carriage bolt 26 and the nut 28 lie substantially flush with the surface of the level transition device 10. Carriage bolts 26 are preferably secured near either end of the level transition device 10, and additional carriage bolts 26 may be placed intermediate thereto, depending upon the width of the level transition device 10. In a preferred embodiment, the carriage bolts 26 and the nut 28 are galvanized.

With reference to FIG. 2, the level transition device 10 is illustrated when installed at the opening of a portable building. As can be seen, the level transition device 10 provides for a relatively smooth transition between a ground level 30 and the sill 32 of the door opening. In a preferred embodiment, the level transition device 10 is secured to the portable building doorsill 32 by means of a pair of lag bolts 34 which are extended through holes 36 drilled transversely through the board 18. The lag bolts 34 may then be screwed into the door opening sill 32 in order to securely attach the level transition device 10 to the portable building. In a preferred embodiment, the lag bolts 34 are placed near opposite ends of the level transition device 10 and are preferably galvanized.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, the preferred embodiment disclosed herein may be modified to accommodate various height transitions. For example, an approximately six inch (6") height transition may use 2"×4", 2"×8" and 2"×12" pieces of stacked board stock. Similarly, a ten inch (10") height transition may use 2"×4", 2"×6", 2"×8", 2"×10" and 2"×12" pieces of stacked board stock.

What is claimed:

1. A portable building comprising:

an enclosure;

an opening in the enclosure;

a sill disposed in the opening;

a level transition device coupled to the sill, the level transition device comprising:

a first board having cross-section dimensions of approximately 2"×4" and cut to a predetermined length;

a second board having cross-sectional dimensions of approximately 2"×6" and cut to the predetermined length;

a third board having cross-sectional dimensions of approximately 2"×10" and cut to the predetermined length;

a fourth board having cross-sectional dimensions of approximately 2"×12" and cut to the predetermined length;

wherein the first, second, third and fourth boards are stacked such that a longitudinal edge of each of said boards are substantially co-aligned;

a first hole drilled through the first, second, third and fourth boards;

a second hole drilled through the first, second, third and fourth boards;

a first bolt disposed through the first hole;

a first nut secured to the first bolt;

a second bolt disposed through the second hole; and a second nut secured to the second bolt;

whereby the first, second, third and fourth boards are held securely together.

2. The level transition device of claim 1, wherein the first, second, third and fourth boards comprise wood.

3. The level transition device of claim 1, wherein the first and second bolts comprise carriage bolts.

4. The level transition device of claim 1, wherein the predetermined length is four feet.

5. The level transition device of claim 1, wherein the first and second holes are countersunk.

6. The portable building of claim 1, wherein the level transition device is coupled to the sill by at least one lag bolt.

* * * * *